US009434043B2

(12) United States Patent
Dürsteler López et al.

(10) Patent No.: US 9,434,043 B2
(45) Date of Patent: Sep. 6, 2016

(54) FINISHED OPHTHALMIC LENS AND CORRESPONDING METHODS

(75) Inventors: Juan Carlos Dürsteler López, Barcelona (ES); Javier Vegas Caballero, Barcelona (ES); Manuel Espinola Estepa, Barcelona (ES)

(73) Assignee: INDO OPTICAL S.L., Barcelona (ES)

( * ) Notice: Subject to any disclaimer, the term of this patent is extended or adjusted under 35 U.S.C. 154(b) by 1363 days.

(21) Appl. No.: 13/138,701

(22) PCT Filed: Mar. 29, 2010

(86) PCT No.: PCT/ES2010/000128

§ 371 (c)(1),
(2), (4) Date: Sep. 20, 2011

(87) PCT Pub. No.: WO2010/112635

PCT Pub. Date: Oct. 7, 2010

(65) Prior Publication Data

US 2012/0013846 A1 Jan. 19, 2012

(30) Foreign Application Priority Data

Mar. 30, 2009 (ES) ..... 200900849

(51) Int. Cl.

| | |
|---|---|
| ***G02C 7/06*** | (2006.01) |
| ***B24B 1/00*** | (2006.01) |
| ***B24B 9/14*** | (2006.01) |
| ***B24B 13/06*** | (2006.01) |
| ***B24B 49/00*** | (2012.01) |

(52) U.S. Cl.

CPC ..... *B24B 13/06* (2013.01); *B24B 9/14* (2013.01); *B24B 49/00* (2013.01)

(58) Field of Classification Search

CPC ..... G02C 7/02; B24B 1/00; B24B 9/14; B24B 9/144; G02C 7/061

USPC ..... 351/159.73, 159, 74, 159.42; 451/43

See application file for complete search history.

(56) References Cited

U.S. PATENT DOCUMENTS

| | | | | |
|---|---|---|---|---|
| 4,561,736 | A * | 12/1985 | Furter | G02C 7/02 251/159 |
| 5,485,399 | A | 1/1996 | Saigo et al. | |
| 5,545,075 | A | 8/1996 | Gottschald | |
| 2009/0067940 | A1 | 3/2009 | Arai et al. | |

FOREIGN PATENT DOCUMENTS

| | | |
|---|---|---|
| EP | 0 576 268 | 12/1993 |
| EP | 1 847 869 | 10/2007 |

OTHER PUBLICATIONS

International Search Report for PCT/ES2010/000128, mailed Jul. 14, 2010.

* cited by examiner

*Primary Examiner* — Scott J Sugarman

(74) *Attorney, Agent, or Firm* — Staas & Halsey LLP

(57) ABSTRACT

Finished ophthalmic lens and corresponding methods. Finished ophthalmic lens having one concave face, one convex face; an outer perimeter with a thickness within a pre-established range; a central useful area that fulfills a pre-established ophthalmic prescription, which defines a machined surface, and which has a useful perimeter that coincides with a perimeter of a pre-established frame; and an outer transition area that joins the useful perimeter of the central useful area to the outer perimeter. A transition area includes a transition surface that extends from the machined surface and as far as the outer perimeter, is continuous and a derivative thereof is continuous on all points, including a joining line between the transition surface and the machined surface.

6 Claims, 7 Drawing Sheets

FINISHED OPHTHALMIC LENS AND CORRESPONDING METHODS

FIELD OF THE INVENTION

The invention relates to a method of machining an ophthalmic lens having one concave face and one convex face and an outer perimeter, where the outer perimeter has a thickness within a pre-established range. The invention also relates to a method of manufacturing a bevelled finished ophthalmic lens. The invention also relates to a finished ophthalmic lens having one concave face and one convex face and an outer perimeter, where the outer perimeter has a thickness within a pre-established range.

STATE OF THE ART

Usually ophthalmic lenses are made from semifinished lens blanks. Semifinished lens blanks usually have a circular outer perimeter and include one convex face (away from the user's eye) and one concave face (near the user's eye). Semifinished lens blanks are produced by combining particular concave faces and particular convex faces. In order to manufacture an ophthalmic lens that fulfils a particular prescription, an "approximate" semifinished lens blank is used and one of its faces is machined so that the machined lens, called the finished lens, fulfils the pre-established prescription.

Finished lenses are usually large enough for most conventional ophthalmic lenses to "fit" inside them. This is done by a bevelling operation, where all the excess material from the finished lens is removed, until said bevelled finished lens is obtained.

Generally, the lenses can be grouped into two large families. On the one hand, negative lenses are those where the curvature radius of the concave surface is less than the curvature radius of the convex surface. Therefore, negative lenses have a thickness that increases as we move away from the optical axis. On the other hand, positive lenses are those where the curvature radius of the concave surface is greater than the curvature radius of the convex surface, or it can even be an opposite sign. In this second case, the thickness of the lens decreases as we move away from the optical eye. Finally it is possible for a lens to be both positive and negative. In fact, progressive lenses can have a negative area and a positive area, whereby the thickness of the lens varies in a complex way from one point to another on the same lens.

By machining the semifinished lens blank so that it fulfils a particular pre-established prescription, there may be problems with the thickness of the outer perimeter of the finished lens. In some cases, this thickness can end up being very big, with the subsequent problem of the lack of material if the thickness of the semifinished lens blank before machining was not sufficient. In other cases, it is possible that the thickness may be excessively fine, and even that it may be null or negative, which means that the perimeter of the finished lens, once it has been machined, is no longer circular, and instead has "recesses". All this hinders the subsequent handling of the finished lens, because conventional methods and machinery have been designed to process finished lenses with a regular outer perimeter.

Moreover, there is a need to manufacture ophthalmic lenses as slim as possible, both to reduce the weight and also for aesthetical reasons. A stage known as the pre-calibrating stage is carried out for this purpose, wherein, by knowing beforehand the perimeter of the particular frame for which the lens is intended, the surface to be machined (which is on one of said concave or convex faces) is positioned with respect to the other face, so that the thickness of the ophthalmic lens is minimized. However, this pre-calibration stage is conditioned by the problems mentioned in the paragraph above.

In this description and claims, the terminology according to the ISO 13666 standard has been used, which establishes the following definitions:

- semifinished blank lens: piece of pre-shaped material that has only one finished optical surface,
- finished lens: lens which has definitive optical surfaces on its two sides; this finished lens can be bevelled (to adjust its perimeter to a particular frame) or not.

In this description and claims, it is considered that the term "finished lens" always relates to the unbevelled lens. For the bevelled lens, the specific term "bevelled finished lens" is used.

SUMMARY OF THE INVENTION

An aim of the invention is to overcome these drawbacks, and propose a new method for pre-calibrating and machining ophthalmic lenses. This purpose is achieved by a method of the type indicated at the beginning, including the following stages:

[a] defining a central useful area with a useful perimeter that coincides with the perimeter of a particular pre-established frame,

[b] defining a surface to be machined on one of the concave and convex faces, so that the concave and convex face, together, are such that they fulfil a particular pre-established ophthalmic prescription in the central useful area,

[c] positioning the surface to be machined, arranged on one of the concave and convex faces, with respect to the other of the concave and convex faces, so that the surface to be machined and its position with respect to the other of the concave and convex faces determines the thickness of the lens along the useful perimeter of the central useful area,

[d] defining a transition area with a transition surface that extends between the useful perimeter of the central useful area and the outer perimeter, where the transition surface extends as a continuation of the surface to be machined as far as the outer perimeter, and where the transition surface is continuous and its derivative is continuous on all points, including the joining line between the transition surface and the surface to be machined.

In fact, this way the pre-calibration can be performed so as to optimize the thickness of the definitive ophthalmic lens; in other words, the one that will be mounted in the frame after the bevelling operation. The pre-calibration should only respect the conditions of the thickness of the lens on its inner point and on the perimeter of the frame, without being influenced by possible conditioning factors arising from the semifinished lens blank, which in the end will not be part of the definitive bevelled lens. A new surface extends from the useful perimeter, i.e.: the transition surface, which is intended to be a joining element between the useful perimeter and the outer perimeter so that the necessary thicknesses are respected. This way, a finished lens is obtained with an outer perimeter that is suitable for subsequent handling, and a central useful area which allows a definitive bevelled lens to be obtained, with an optimally minimized thickness as it is individualized, because it takes into account the frame on which the definitive lens will be mounted.

These steps of the method, which detail the inventive way of performing the lens pre-calibration step, are followed by the normal machining step performed on the surface to be machined and the transition surface.

Therefore, as can be seen, the new method allows "double optimization": on the one hand, the thickness of the lens is optimized (i.e. the definitive lens, after bevelling) and, on the other hand, the thickness and geometry of the finished lens is optimized, so that it is possible to handle and process it adequately, while considering the frame on which the lens is intended to be mounted.

Preferably in step [d] an outer perimeter is obtained which, apart from maintaining its thickness within the pre-established range, minimizes the curvature variation in an angular direction. In fact, the thickness of the outer perimeter is preferably constant, but this cannot be obtained in every case or, at least it is not advisable to force it because other advantageous surface characteristics are lost. Therefore, the only input noted is a pre-established thickness range, where the maximum value is preferably the thickness value of the ophthalmic lens predetermined before machining, and the minimum value is preferably 0.3 mm. Values below this minimum value cause problems in the subsequent handling and processing of the lens, for example, with polishing cloths. However, as mentioned previously, it is advantageous to minimize the curvature variations in the angular direction; in other words, the thickness variations of the outer perimeter.

Advantageously step [d] specifies the minimum curvature radius of the cutting tools that are used to machine the transition surface, and defines the transition surface so that it has a main minimum curvature radius on all points, which is greater than the minimum curvature radius of the cutting tools. In fact, given that it is necessary for the cutting tool to have a smaller curvature radius than the minimum curvature of the surface that is being machined, it is advantageous to already bear this in mind during the design stage of the transition surface.

The method according to the invention can be used advantageously both when the central area is a positive lens (as the thickness of the central area can be minimized, only making sure that the thickness on the transition perimeter fulfils particular minimum thickness requirements, and without worrying about the outer perimeter of the finished lens) and when the central area is a negative lens (without worrying about the outer perimeter of the finished lens which, in cases of severe short-sightedness, could end up having to be much greater than the outer thickness of the original semifinished lens blank). Logically the method is particularly interesting in the case of progressive lens, where positive and negative areas can coexist.

Preferably step [b] includes, in addition, a stage of optimising the distribution of aberrations wherein the perimeter of the particular pre-established frame is taken into account so as to optimize the distribution of aberrations inside said perimeter. In fact, the method according to the invention necessarily requires knowing the real and specific frame that the user chooses so as to be able to perform an optimum pre-calibration. Therefore, since this information is already available (the internal perimeter of the ring of the frame chosen by the user), it can also be used to optimize the distribution of aberrations on the finished lens, so that said aberrations are optimally distributed inside the perimeter of the frame. This optimization is particularly interesting in the case of progressive lenses, as progressive lenses always have stigmatic aberrations that are distributed in a complex, compromising way across the lens surface.

The invention is also aimed at a method of manufacturing a finished, bevelled ophthalmic lens including a method of machining a lens according to the invention and, additionally, a bevelling step along the useful perimeter, thus obtaining a bevelled lens, so that the bevelled lens is shaped completely from the central useful area.

An aim of the invention is also a finished ophthalmic lens having one concave face and one convex face and an outer perimeter, where the outer perimeter has a thickness within a pre-established range, wherein: [a] it has a central useful area wherein the concave face and the convex face are such that they fulfil a particular, pre-established ophthalmic prescription and where one of said concave and convex faces defines a machined surface, where the central useful area has a useful perimeter that coincides with the perimeter of a particular, pre-established frame, and [b] it has an outer transition area that joins the useful perimeter of the central useful area to the outer perimeter, where the transition area includes a transition surface that extends as a continuation of the machined surface as far as the outer perimeter, and where the transition surface is continuous and its derivative is continuous on all points, including the joining line between the transition surface and the machined surface. In fact, this finished ophthalmic lens has, on the one hand, a central useful area from which an ophthalmic lens with an optimized thickness can be bevelled, while the finished ophthalmic lens has an outer perimeter that is also optimized for handling.

The invention is also used advantageously both when the central area is a positive lens and when the central area is a negative lens. Also, as mentioned before, it is also advantageous when the lens is a progressive lens.

BRIEF DESCRIPTION OF THE DRAWINGS

Other advantages and characteristics of the invention will be appreciated from the following description, wherein, in a non-limiting way, some preferable embodiments of the invention are described, with reference to the accompanying drawings, in which.

DESCRIPTION OF EMBODIMENTS

Figure 1:
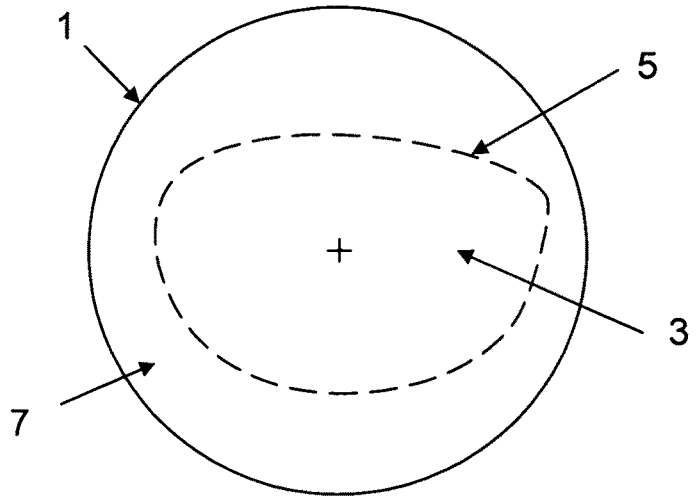
FIG. 1 is a finished lens according to the invention.

FIG. 1 shows a finished ophthalmic lens according to the invention. The ophthalmic lens has an outer perimeter 1, normally of a standardized value, such as for example 65 mm in diameter. Inside there is a central useful area 3 defined by a useful perimeter 5 that coincides with the perimeter of a particular, pre-established frame; in other words, a frame that has been chosen by the user and in which the lens that is being manufactured has to be housed. Between useful perimeter 5 and outer perimeter 1 there extends a transition area 7, which is the area that will be removed during the bevelling operation. Therefore, transition area 7 is a non-useful area from the optical point of view.

In other words, the shape of the frame determines a central useful area 3 of the definitive lens that fulfils the optical properties the lens must have in order to adequately correct the user's vision. In this respect, when it says that central useful area 3 fulfils a particular, pre-established ophthalmic prescription, it must be understood that it fulfils it, just as this expression is understood conventionally. So, for example, a progressive lens has an area of far vision, an area of near vision and an intermediate passage that strictly fulfil the user's needs, and a wider area where the appearance of aberrations is inevitable (particularly, astigmatism). Nevertheless, it is considered that the lens, overall, fulfils a particular ophthalmic prescription, corresponds to said prescription, or is suitable for said prescription.

The area of the finished lens that remains outside the contour of the frame becomes an optically non-useful area, where a surface will be defined that will not have particular optical properties, but will have geometrical properties, which will make it possible to join the edge of central useful area 3 defined by the frame (in other words, useful perimeter 5) to the edge of the finished lens, that is, outer perimeter 1. The semifinished ophthalmic lens blank has one convex face and one concave face (which is the face that remains nearest the user's eye). In the examples described below the concave face is the one with the surface to be machined, although the invention could be applied conceptually in the same way if the surface to be machined were the convex face.

Figure 2:
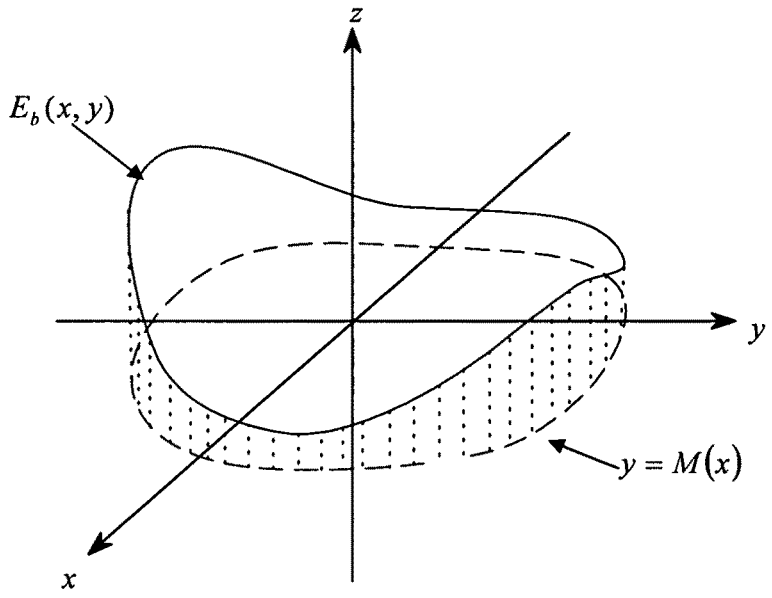
FIG. 2 is a flat curve that defines the perimeter of the frame and the thickness of the associated edge.

To carry out the method according to the invention, we start with a lens that has already been optimized according to assembly, prescription and frame parameters, so that there is a frame contour usually defined by a flat curve $y=M(x)$ (it can also be described in polar co-ordinates $r=M(\theta)$) to which an edge thickness $E_b=E_b(x,y)$ is associated, as can be seen in FIG. 2.

Figure 3:
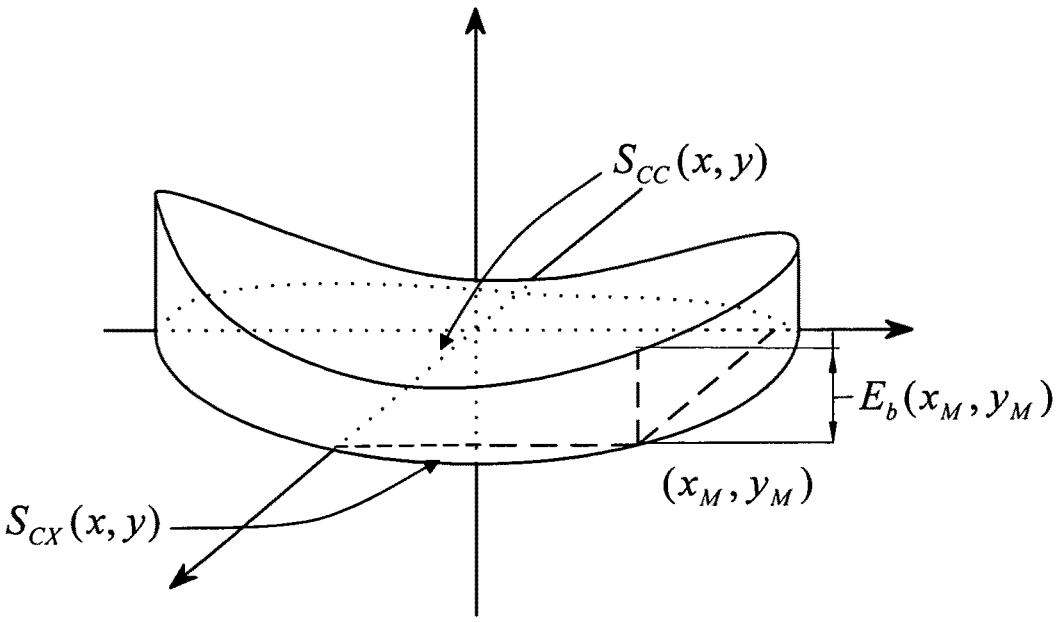
FIG. 3 is the central useful area of a finished lens according to the invention.

The lens (see FIG. 3) is determined by two surfaces, the concave one and the convex one. The convex surface ($S_{CX}=S_{CX}(x,y)$) is pre-established by the convex face of the semifinished lens blank to be machined, while the concave surface ($S_{CC}=S_{CC}(x,y)$) is designed so that the lens system made up of the two surfaces has the suitable prescription. This concave surface is the one that has been called the surface to be machined. It is fulfilled that the difference between the contour points of the frame (on useful perimeter 5) between the two surfaces, is the above-mentioned edge thickness:

$$S_{CC}(x_M,y_M)-S_{CX}(x_M,y_M)=E_b(x_M,y_M)\ (x_M,y_M)\epsilon y=M(x)$$

Once central useful area 3 of the lens is completely defined by its contour or useful perimeter 5 and its surfaces, a surface (transition surface) has to be designed that joins the edge of the surface to be machined to the edge of the finished lens of thickness $E_b^{ST}=E_b^{ST}(x_L,y_L)$ (that is, outer perimeter 1) where the points $(x_L,y_L)$ belong to the flat curve that defines the limits of the semifinished lens blank $y=M_{ST}(x)$ (normally circumference). This thickness does not have to be the thickness of the predefined edge, as it can be modified.

The transition surface, $T=T(x,y)$ has to fulfil particular continuity requirements so that the numeric control machine can cut the lens. In this respect it is advantageous that the transition surface fulfils at least one continuity $C^1$, in other words, that it is continuous and also that its first derivative is continuous. Therefore, for each point on the contour of the frame $(x_M,y_M)$, where the surface to be machined and the transition surface connect, the following is fulfilled:

$$S_{CC}(x_M,y_M)=S_{CX}(x_M,y_M)+E_b(x_M,y_M)=T(x_M,y_M)$$

$$S'_{cc}(x_M,y_M)=T'(x_M,y_M)\ \text{with}(x_M,y_M)\epsilon y=M(x)$$

Another contour condition that the new transition surface has to fulfil is that on the edge of the lens on the concave surface it has to coincide with the desired thickness of the finished lens, in other words, with the thickness of the outer perimeter:

$$T(x_L,y_L)=S_{CC}(x_L,y_L)+E_b^{ST}(x_L,y_L)\ \text{with}$$

$$(x_L,y_L)\epsilon y=M_{ST}(x)$$

The thickness of the outer perimeter of the finished lens can be fixed in several ways. Preferably it is limited within "absolute" maximum and minimum values for practical reasons. Moreover, it is recommendable that the maximum value is not greater than the thickness value of the original semifinished lens blank because, otherwise, there would be the problem of the lack of material for obtaining the desired thickness. Furthermore, it is recommendable that the lens has a certain thickness so that it can be handled subsequently. This minimum thickness is preferably greater or equivalent to 0.3 mm, because if the thickness is less there tend to be problems with the polishing cloths. Apart from these "absolute" maximum and minimum values, in each case, it may be recommendable to set other maximum and minimum values according to other conditions. So, generally, it is recommendable that the thickness be as constant as possible. Moreover, as will be seen later, the method of calculating the transition surface and the method of machining the transition surface (particularly the radii of the machining tools) can impose other limits.

Figure 4:
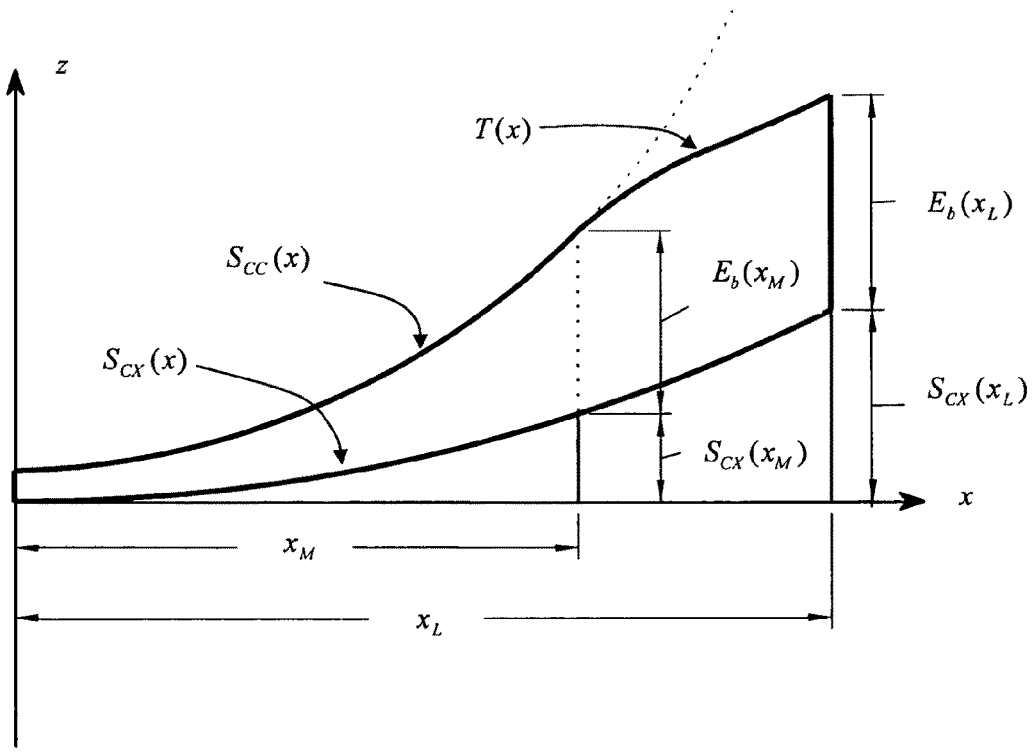
FIG. 4 is a cross-section of a finished lens according to the invention, where the central useful area is negative.

FIG. 4 shows a cross-section of a lens according to the invention, in particular, a negative lens. The two-dimensional profile of the lens can be seen, for a fixed "y" co-ordinate, where the pre-calibrating surfaces can be observed. On the one hand, the convex face of the lens corresponds to the surface of the semifinished lens blank. On the concave face of the lens we can see the surface corresponding to central useful area 3 (in other words, the surface to be machined) up to the limit co-ordinate of the frame and afterwards the transition surface up to the edge of the finished lens.

Figure 5:
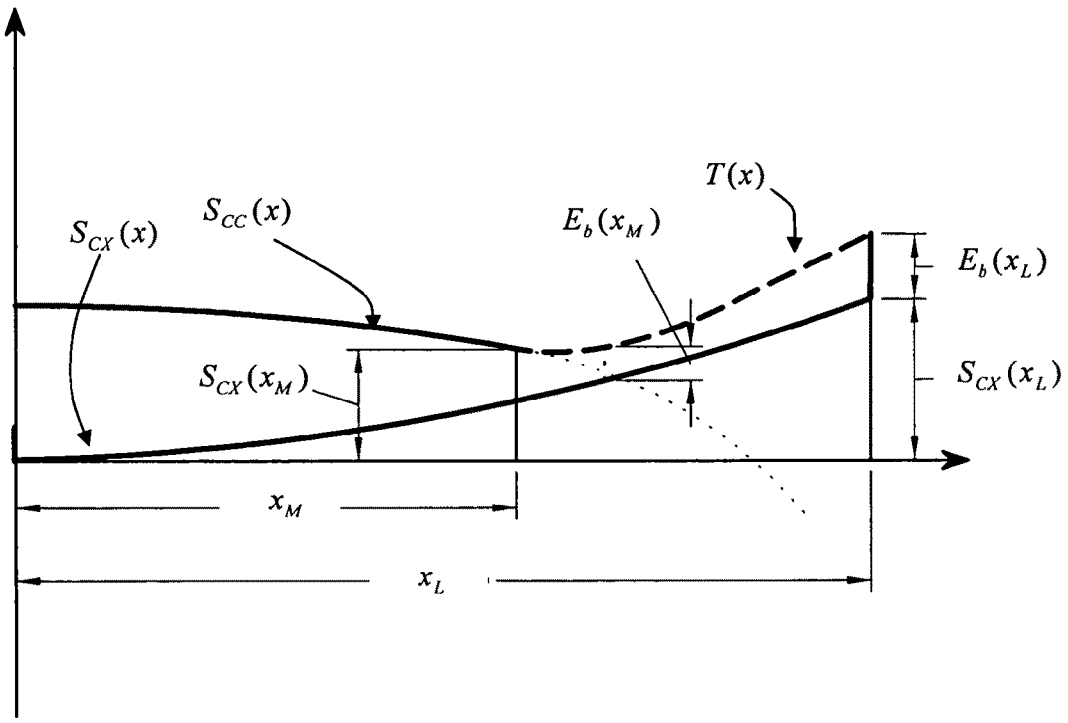
FIG. 5 is a cross-section of a finished lens according to the invention, wherein the central useful area is positive.

For its part, FIG. 5 is equivalent to FIG. 4, but shows a positive lens.

Figure 7:
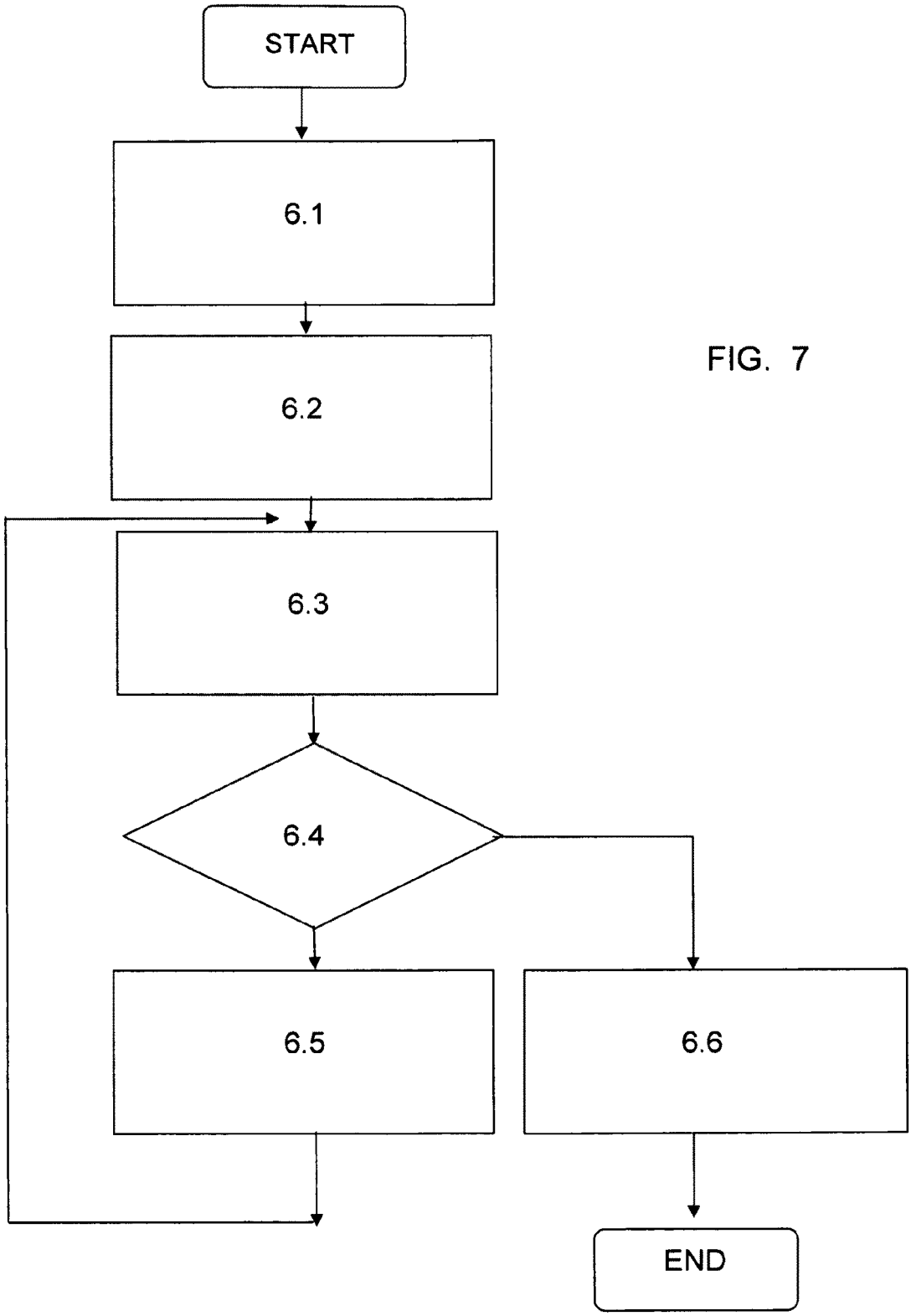
FIG. 7 is a flow diagram of a method according to the invention.

A description is provided below of an example of a method of machining an ophthalmic lens according to the invention, represented schematically as a flow diagram in FIG. 7:

In the case of a positive lens, like the one shown in FIG. 5:

1—First of all the data of the frame perimeter and the two faces (concave and convex) of the ophthalmic lens, which must be mounted in the frame, are obtained; in other words, the data on the central useful area 3 and the useful perimeter 5. These data will already include the results of a pre-calibration which makes it possible to optimize the thickness of central useful area 3. (Reference 6.1).

2—A safety surface is defined, parallel to the convex face and separated therefrom by a particular safety thickness. This safety thickness is a minimum thickness which makes it possible to guarantee that negative thicknesses (in other words, holes) are not formed. Preferably this safety thickness is less than the minimum value of the range pre-established for the thickness of outer perimeter 1. This way, it is possible to maximally optimize the thickness reduction in the central useful area 3. (Reference 6.2).

3—The transition surface is defined, which extends between the surface to be machined and outer perimeter 1, a series of curves are drawn that propagate radially from the useful perimeter 5 to the outer perimeter 1. For every curve, the following is taken into account:

3.1—The initial point of the curve coincides with the end point of the surface to be machined, and the joining point must be continuous and with a continuous derivative.

3.2—From this initial point a pre-established curve is drawn, which preferably is a circumferential arch but which could be any other type of pre-established curve (parabola, cubic curve, etc.). This curve must be tangential to the safety surface at a particular contact point. To this end the radius of the circumference is calculated which makes it possible to fulfil this condition, called contact radius. (Reference 6.3). Three cases may result from this:

3.2.1—No contact radius is obtained that fulfils the pre-established condition. This means that at no event can the curve drawn cut the safety surface. In this case the curvature radius is determined by taking into account other conditioning factors that will be discussed later.

3.2.2—The contact radius that fulfils the pre-established condition has the consequence that the tangent point is outside outer perimeter 1. This also means that in reality, given that the finished lens ends on its outer perimeter 1, the curve drawn will not cut the safety surface at any time. In this case, the curvature radius can also be determined by taking into account other conditioning factors that will be discussed later.

3.2.3—The contact radius that fulfils the pre-established condition has the consequence that the contact point is between the useful perimeter 5 and the outer perimeter 1. In this case the contact point acts as an initial point for a second curve that will extend between the contact point and the outer perimeter 1.

3.3—Each second curve is calculated following the same steps as in point 3.2 above, taking the contact points obtained as the initial point. (Reference 6.5). This iterative process ends when all the points in case 3.2.3 above have been treated. (Reference 6.4). These second curves must also fulfil the following requirements:

3.3.1—Its curvature radius is less than the contact radius obtained.

3.3.2—Its curvature radius must be greater than the radius curvature of the smallest tool envisaged in the machining process.

3.3.3—It is C1; in other words, continuous and with a continuous derivative.

3.3.4—The thickness of transition area 7 is on all points greater or equivalent to the safety thickness.

4—When all the contact points of all the curves are outside the outer perimeter 1 (case 3.2.2 above) or do not exist (case 3.2.1 above), then the earlier iterative process is finished and a curve is calculated that optimizes the thickness of outer perimeter 1, (Reference 6.6), while also fulfilling the following conditions:

4.1—Its curvature radius is less (or equivalent) than the contact radius obtained.

4.2—Its curvature radius must be greater than the curvature radius of the smallest tool envisaged in the machining process.

4.3—It is C1.

4.4—The thickness of transition area 7 is on all points greater or equivalent to the safety thickness.

4.5—In order to determine the curvature radius it is important to bear in mind that the thickness of the outer perimeter must be included within some minimum and maximum values ($E_{bmin}$ y $E_{bmax}$). The value of $E_{bmin}$ will be the one obtained when the curvature radius is the contact radius, while value $E_{bmax}$ will be the one that is limited by the radius of the machining tool. Logically, $E_{bmin}$ and $E_{bmax}$ must always be within a range of absolute maximum and minimum values. Moreover, it is recommendable that the thickness be constant (or as constant as possible). To this end, a possible strategy is to make the thickness of one given point on the outer perimeter equivalent to the adjacent point, in an angular direction, providing this does not mean going beyond the limits indicated above. It is also important to take into account that the outer perimeter must fulfil basic continuity and manufacturing requirements (in other words, that the main minimum curvature radius is greater than the curvature radius of the smallest tool to be used). So, once the thickness has been set for one given point, the curvature radius of the second curve can be calculated.

Figure 6:
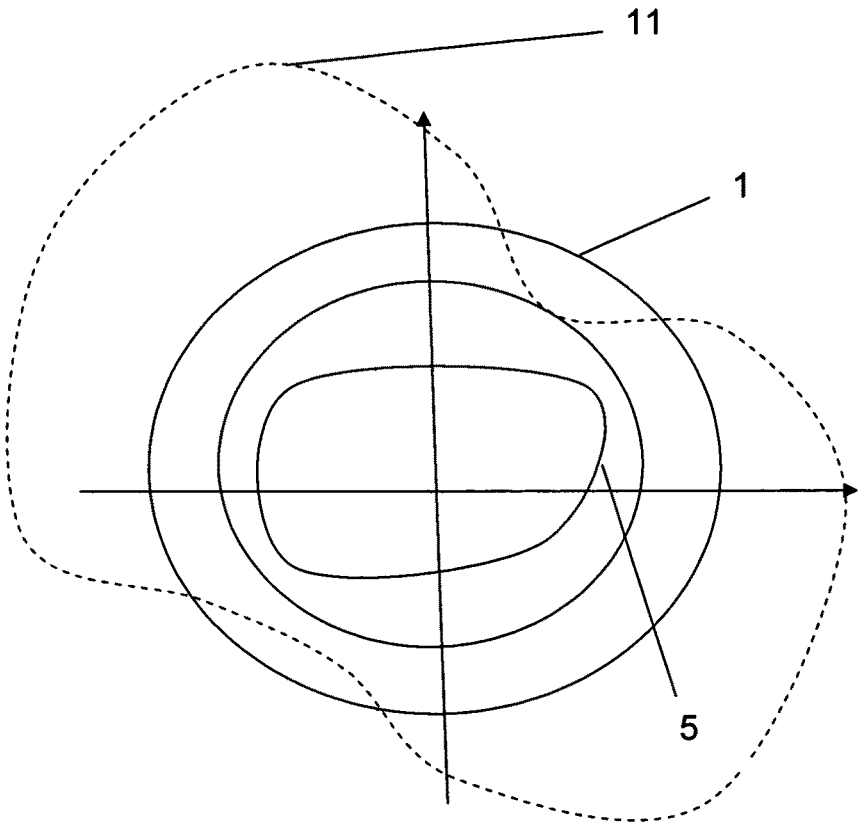
FIG. 6 is a finished lens according to the invention with a dotted line showing the shape of the contact points.

FIG. 6 shows schematically a semifinished lens blank with the useful perimeter 5 and the outer perimeter 1, where the dotted line shows the contour of the points of contact 11.

Although the example described has been based on a positive lens, it can equally be applied conceptually for a negative lens (such as the one in FIG. 4), or even for lenses that combine positive and negative areas. In fact, this invention is applied particularly advantageously to progressive lenses.

Figure 8A:
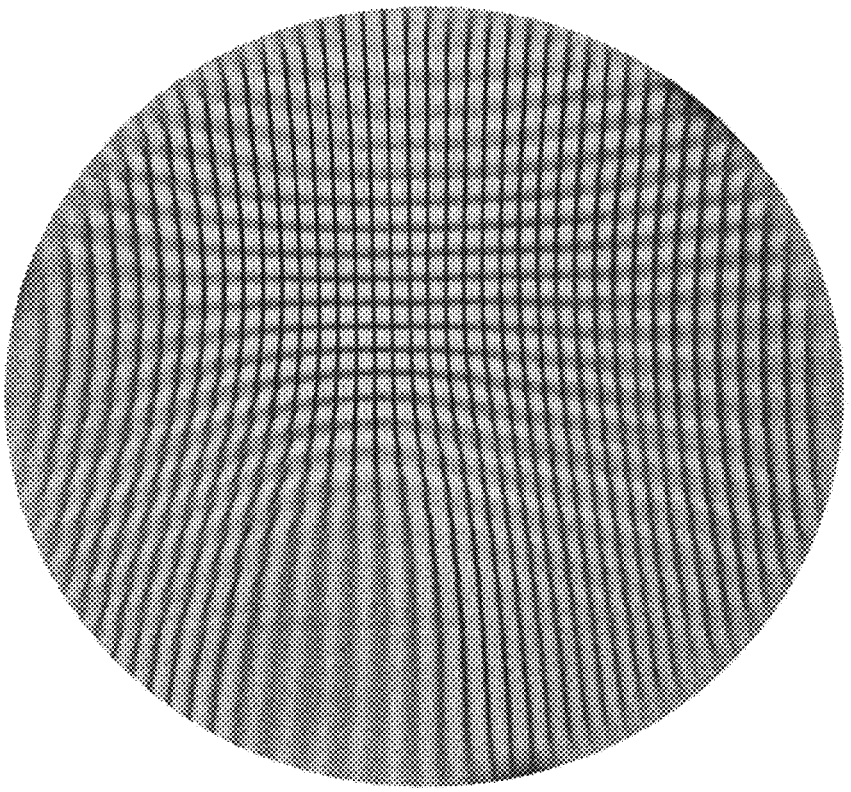
FIGS. 8A and 8B are graphic representations of the distortion caused in one grid, by a conventionally finished progressive lens and a progressive finished lens, respectively, according to the invention.
Figure 8B:
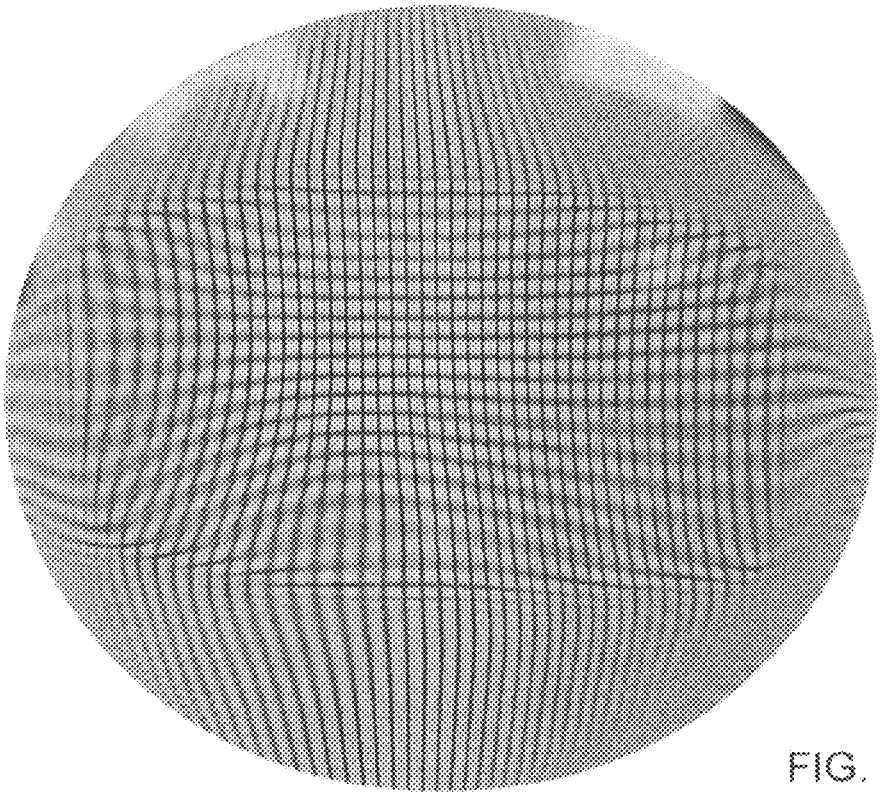

FIGS. 8A and 8B show some photographs that feature, respectively, a progressive finished conventional ophthalmic lens and a progressive finished ophthalmic lens according to the invention, respectively, arranged on a grid. In the distortion produced on the grid, the differences between both finished lenses can be clearly seen. In particular, in the finished lens according to the invention, the existence of two areas (the central useful area and the transition area) can be seen, and the "thumbprint" of the useful perimeter is shown, that is, of the perimeter of the frame wherein it is envisaged to mount the lens once it is bevelled.

The invention claimed is:

1. Method of machining an ophthalmic lens having one concave face and one convex face and an outer perimeter, where said outer perimeter has a thickness within a pre-established range, comprising:

(a) defining a central area with a perimeter that coincides with a perimeter of a pre-established frame and such that the central area is a progressive lens;

(b) defining a surface to be machined on one of said concave and convex faces, so that said concave and convex faces, together, fulfil a pre-established ophthalmic prescription in said central area;

(c) positioning said surface to be machined, arranged on the one of said concave and convex faces, with respect to the other of said concave and convex faces, so that said surface to be machined and the position of said surface to be machined with respect to the other of said concave and convex faces determines the thickness of the lens along said perimeter in said central area;

(d) defining a transition area with a transition surface that extends between said perimeter of said central area and said outer perimeter, wherein the transition surface extends from the surface to be machined as far as said outer perimeter, and wherein said transition surface is continuous and a derivative thereof is continuous on all points, including a joining line between said transition surface and said surface to be machined; and (e) machining the transition surface in the surface to be machined of the ophthalmic lens.

2. Method according to claim 1, wherein, in said step (d), the outer perimeter is obtained which, apart from maintaining the thickness within the pre-established range, minimizes a curvature variation in an angular direction.

3. Method according to claim 1, wherein step (d) further comprises:

specifying a minimum curvature radius of a tool used to machine said transition surface, and defining said transition surface to have a main minimum curvature radius on all points, which is greater than the minimum curvature radius of said tool.

4. Method according to claim 1, wherein step (b) further comprises:

optimizing a distribution of aberrations, wherein the perimeter of said pre-established frame is taken into account so that the distribution of aberrations inside said perimeter of the frame can be optimized.

5. Method of manufacturing a finished bevelled ophthalmic lens according to claim 1, further comprising:

bevelling said perimeter of the central area to form a bevelled lens which is shaped completely from said central area.

6. Finished ophthalmic lens comprising:

one concave face;

one convex face;

an outer perimeter, wherein said outer perimeter has a thickness within a pre-established range and a central area;

wherein said concave face and said convex face fulfil a pre-established ophthalmic prescription, wherein one of said concave and convex faces defines a machined surface, wherein said central area has a perimeter that coincides with a perimeter of a pre-established frame; and a transition area that joins said perimeter of said central area to said outer perimeter, wherein said transition area includes a transition surface that extends between said machined surface and as far as said outer perimeter, wherein said transition surface is continuous and a derivative thereof is continuous on all points, including a joining line between said transition surface and said machined surface, and wherein said central area is a progressive lens.

* * * * *